US005525452A

United States Patent [19]

Hopper et al.

[11] Patent Number: 5,525,452

[45] Date of Patent: Jun. 11, 1996

[54] TONER AGGREGATION PROCESSES

[75] Inventors: Michael A. Hopper, Toronto; Raj D. Patel, Oakville; Grazyna E. Kmiecik-Lawrynowicz, Burlington, all of Canada

[73] Assignee: Xerox Corporation, Stamford, Conn.

[21] Appl. No.: 497,988

[22] Filed: Jul. 3, 1995

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,370,963 | 12/1994 | Patel et al. | 430/137 |
| 5,405,728 | 4/1995 | Hopper et al. | 430/137 |
| 5,418,108 | 5/1995 | Kmiecik-Lawrynowicz et al. | 430/137 |

*Primary Examiner*—Roland Martin
*Attorney, Agent, or Firm*—E. O. Palazzo

[57] ABSTRACT

A process for the preparation of toner compositions comprising (i) preparing a pigment dispersion in water, which dispersion is comprised of a pigment, an ionic surfactant, and optionally a charge control agent;

(ii) shearing said pigment dispersion with an aqueous latex or emulsion blend comprised of a nonionic surfactant, resin, and a counterionic surfactant with a charge polarity of opposite sign to that of said ionic surfactant;

(iii) heating the above sheared blend below about the glass transition temperature (Tg) of the resin to form electrostatically bound toner size aggregates with a narrow particle size distribution;

(iv) heating the electrostatically bound aggregates above about the Tg of the resin, which heating is accomplished at a pH of from about 4.0 to about 6.0 while continuously stirring the electrostatically bound aggregates to form toner particles;

(v) washing the toner particles with a basic aqueous solution, which solution is of a pH of from between about 10.0 and about 12.0; and thereafter optionally (iv) separating the toner particles from the emulsion blend containing water by filtration and then drying the toner particles.

26 Claims, No Drawings

TONER AGGREGATION PROCESSES

BACKGROUND OF THE INVENTION

The present invention is generally directed to toner processes, and more specifically, to aggregation and coalescence processes for the preparation of toner compositions comprised, for example, of toner resins, or polymers, pigment, and toner additives, such as charge control agents. In embodiments, the present invention is directed to the economical chemical preparation of toners without the utilization of the known pulverization and/or classification methods, and wherein toners with an average volume diameter of from about 0.5 to about 25, and preferably from 1 to about 10 microns and narrow GSD can be obtained. The resulting toners can be selected for known electrophotographic imaging and printing processes, including color processes, and lithography. In embodiments, the present invention is directed to a process comprised of dispersing a pigment and optionally a charge control agent or additive in water containing an ionic surfactant, and shearing this mixture with a latex mixture comprised of suspended resin particles of, for example, from about 0.05 micron to about 1 microns in volume diameter, in water containing a counterionic surfactant in amounts of from about 0.5 to 5 percent (weight percent) of the mass of the latex with opposite charge to the ionic surfactant of the pigment dispersion, and nonionic surfactant, thereby causing flocculation of the resin particles, pigment particles and optional charge control particles, followed by heating below, for example from about 5 to about 20° C., the Tg of the resin, and stirring of the flocculent mixture, which is believed to form statically bound aggregates of from about 0.5 micron to about 5 microns, comprised of resin, pigment and optionally charge control, and thereafter heating at, for example, from about 10° to about 50° C., above the Tg of the latex resin, and which heating is accomplished at a certain pH, such as from between about 4 and 6, to generate toners with an average particle volume diameter of from about 1 to about 25 microns It is believed that during the higher temperature heating stage the aggregate particles fuse together to form toners. In another embodiment thereof, the present invention is directed to an in situ chemical process comprised of first dispersing a pigment, such as HELIOGEN BLUE™ or HOSTAPERM PINK™, in water containing a cationic surfactant such as benzalkonium bromide (SANIZOL B-50™), utilizing a high shearing device, such as a Brinkmann Polytron, microfluidizer or sonicator, thereafter shearing this mixture with a latex of suspended resin particles, such as PLIOTONE™, comprised of poly(styrenebutadiene), and of particle size ranging from 0.01 to about 0.5 micron in average volume diameter as measured by the Brookhaven nanosizer in an aqueous surfactant mixture containing an anionic surfactant, such as sodium dodecylbenzene sulfonate, for example NEOGEN R™ or NEOGEN SC™, and nonionic surfactant such as alkyl phenoxy poly(ethylenoxy-)ethanol, for example IGEPAL 897™ or ANTAROX 897™, thereby resulting in a flocculation, or heterocoagulation of the resin particles with the pigment particles; and which on further stirring, from, for example, about 1 to about 3 hours, while heating below the Tg of the latex resin results in formation of statically bound aggregates ranging in size of from about 0.5 micron to about 10 microns in average diameter size as measured by the Coulter Counter (Microsizer II); and thereafter heating to, for example, from about 5 to about 50° C. above the Tg of the latex resin of, for example, from about 60 to about 95° C. to provide for particle fusion or coalescence of the polymer and pigment particles, and which heating is accomplished at a critical pH of between 4 and 6 units; followed by washing with, for example, hot water to remove surfactant, and drying whereby toner particles comprised of resin and pigment with various particle size diameters can be obtained, such as from 1 to 12 microns in average volume particle diameter. The aforementioned toners are especially useful for the development of colored images with excellent line and solid resolution, and wherein substantially no background deposits are present. In embodiments, the toner particles formed are washed with a base, such as sodium hydroxide, to control the triboelectric characteristics thereof. This washing, which can be conducted by using a solution of base to achieve a solution pH of from between 10 and 12 where the base is a material, such as sodium hydroxide, potassium hydroxide, ammonium hydroxide or any other completely water soluble material, can for example enable increases in the tribocharge of dried toner particles from between 10 and 25 microcoulombs per gram to between 30 and 75 microcoulombs per gram.

While not being desired to be limited by theory, it is believed that the flocculation or heterocoagulation is formed by the neutralization of the pigment mixture containing the pigment and cationic surfactant absorbed on the pigment surface, with the resin mixture containing the resin particles and anionic surfactant absorbed on the resin particle. The high shearing stage ensures the formation of a uniform homogeneous flocculated system, or gel from the initial inhomogeneous dispersion, which results from the flocculation action, and allows the formation of stabilized aggregates that are negatively charged and comprised of the resin and pigment particles of about 5 to about 5 microns in volume diameter. Thereafter, heating is applied to fuse the aggregated particles or coalesce the particles to toner comprised of polymer and pigment, and optionally charge control agent. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by homogenization to form statically bounded aggregate particles by stirring of the homogeneous mixture, and toner formation after heating. The latex resin particles for the aggregation are selected primarily for their functional performance in the xerographic process, especially the process involved with fixing the image to the final receptor medium, usually paper. Of importance is the pH as indicated herein which enables the production of a toner with substantially spherical shape, for example with a smooth surface, especially when heating is accomplished at 90° C., at a pH of between 4 and 6, and wherein heating is effected, for example, for 4 hours.

In reprographic technologies, such as xerographic and ionographic devices, toners with average volume diameter particle sizes of from about 9 microns to about 20 microns have been effectively utilized. Moreover, in some xerographic systems, such as the high volume Xerox Corporation 5090 copier-duplicator, high resolution characteristics and low image noise are highly desired, and can be attained utilizing the small sized toners of the present invention with an average volume particle of less than 11 microns, preferably less than about 7 microns and more preferably from 1 to about 7 microns, and with narrow geometric size distribution (GSD) of from about 1.2 to about 1.3. Additionally, in some xerographic systems wherein process color is utilized, such as pictorial color applications, small particle size colored toners of from about 3 to about 9 microns are desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications, wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about: 1 to 7 microns, and with higher pigment loading, such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures such as from about 120° to about 150° C. thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is preferred, low gloss paper is utilized such as from about 1 to about 30 gloss units as measured by the Gardner Gloss metering unit, and which after image formation with small particle size toners of from about 3 to about 5 microns and fixing thereafter results in a low gloss toner image of from above about 1 to about 30 gloss units as measured by the Gardner Gloss metering unit. Alternatively, when higher image gloss is desired, such as from about above 30 to about 60 gloss units as measured by the Gardner Gloss metering unit, higher gloss paper is utilized, such as from above about 30 to about 60 gloss units, and which after image formation with small particle size toners of the present invention of from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns, such that the pile height of the toner layer(s) is low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about above 1.4 to about 2.0. In such processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns lower toner yields are obtained after classification, such as from about 50 percent to about 70 percent. With the processes of the present invention in embodiments, small average particle sizes of from about 3 microns to about 9 microns, and preferably 5 microns are attained without resorting to classification processes, and wherein narrow geometric size distributions are attained, such as from about 1.16 to about 1.35, and preferably from about 1.16 to about 1.30. High toner yields are also attained, such as from about 90 percent to about 98 percent, in embodiments. In addition, by the toner particle preparation process of the present invention in embodiments, small particle size toners of from about 3 microns to about 7 microns can be economically prepared in high yields such as from about 90 percent to about 98 percent by weight based on the weight of all the toner material ingredients.

There is illustrated in U.S. Pat. No. 4,996,127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of an acrylic acid polar group, see the Comparative Example. The process of the present invention need not utilize polymers with polar acid groups, and toners can be prepared with resins such as poly(styrene-butadiene) or PLIOTONE™ without containing polar acid groups. Additionally, the toner of the '127 patent does not appear to utilize counterionic surfactant and flocculation processes. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate which results in the formation of particles with wide GSD. Furthermore, the '488 patent does not, it is believed, disclose the process of counterionic flocculation, and the importance of solid contents to control particle size. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of opposite charges can be selected; and U.S. Pat. No. 4,558,108, wherein there is disclosed a process for the preparation of a copolymer of styrene and butadiene by specific suspension polymerization. Other patents mentioned are U.S. Pat. Nos. 3,674,736; 4,137,188 and 5,066,560.

In U.S. Pat. No. 5,290,654, the disclosure of which is totally incorporated herein by reference, there is disclosed a process for the preparation of toners comprised of dispersing a polymer solution comprised of an organic solvent and a polyester, and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising a halogenization procedure which, for example, chlorinates the outer surface of the toner and results in enhanced blocking properties. More specifically, this patent application discloses an aggregation process wherein a pigment mixture containing an ionic surfactant is added to a resin mixture containing polymer resin particles of less than 1 micron, nonionic and counterionic surfactant, thereby causing a flocculation to statically bound aggregates of about 0.5 to about 5 microns in volume diameter as measured by the Coulter Counter, and thereafter heating to form toner composites or toner compositions of from about 3 to about 7 microns in volume diameter.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference, there is disclosed a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles to form said toner composition comprised of polymeric resin, pigment and optionally a charge control agent.

In U.S. Pat. No. 5,370,963, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,344,738, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In U.S. Pat. No. 5,403,693, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0. 1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45 to about 90° C. and preferably from between about 50 and about 80° C., the statically bound aggregated particles to form said toner composition comprised of resin, pigment and optional charge control agent.

Moreover emulsion/aggregration processes for the preparation of toners are illustrated U.S. Pat. No. 5,418,108 and U.S. Pat. No. 5,364,729, the disclosures of which are totally incorporated herein by reference.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ chemical processes for black and colored toner compositions by an aggregation process comprised of (i) preparing a pigment dispersion, which dispersion is comprised of a pigment, an ionic, that is anionic or cationic, surfactant, and optionally a charge control agent;

(ii) shearing the pigment dispersion with a latex or emulsion blend comprised of resin, a counterionic surfactant with a charge polarity of opposite sign to that of the ionic surfactant and a nonionic surfactant;

(iii) heating the above sheared blend below about the glass transition temperature (Tg) of the resin to form electrostatically bound toner size aggregates with a narrow particle size distribution; and (iv) heating the bound aggregates above about the Tg of the resin, which heating is accomplished at a pH of from about 4.0 to about 6.0, followed by washing with a base; and moreover processes for the preparation of spherical toners by heating at a pH of 4 to 6, and higher tribocharged toners by washing at a pH of 10 to 12.

In a further object of the present invention there is provided a process for the preparation of toners, especially with a desired morphology, with an average particle diameter of from between about 0.5 to about 20 microns, and preferably from about 1 to about 10 microns, and with a narrow GSD of from about 1.15 to about 1.35 and preferably from about 1.2 to about 1.3 as measured by the Coulter Counter.

Moreover, in a further object of the present invention there is provided a process for the preparation of toners which after fixing to paper substrates result in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification, and wherein by varying the latex concentration and maintaining the latex/coagulant ratio provides toner aggregates at various size diameters.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles, with pigment particles dispersed in water and surfactant, and wherein the aggregated particles, of toner size, can then be caused to coalesce by, for example, heating at certain important pH of between 4 to 6. In embodiments, some factors of importance with respect to controlling particle size and GSD include the concentration of the surfactant used for the pigment dispersion, concentration of the component, like acrylic acid in the latex, the temperature of coalescence, the solids contents, and the time of coalescence.

These and other objects of the present invention are accomplished in embodiments by the provision of toners and processes thereof. In embodiments of the present invention, there are provided processes for the economical direct preparation of toner compositions by an improved flocculation or heterocoagulation, and coalescence processes accomplished at a certain pH.

In embodiments, the present invention is directed to a process for the preparation of toner compositions comprising (i) preparing a pigment dispersion, which dispersion is comprised of a pigment, an ionic, that is anionic or cationic, surfactant, and optionally a charge control agent;

(ii) shearing the pigment dispersion with a latex or emulsion blend comprised of resin, a counterionic surfactant with a charge polarity of opposite sign to that of the ionic surfactant, and a nonionic surfactant;

(iii) heating the above sheared blend below about the glass transition temperature (Tg) of the resin to form electrostatically bound toner size aggregates with a narrow particle size distribution; and (iv) heating the electrostatically bound aggregates above about the Tg of the resin which heating is accomplished at a pH of from about 4 to about 6, that is for example about 4, 5, or 6, followed by washing with a base; and to processes which comprise (i) preparing a pigment dispersion in water, which dispersion is comprised of pigment, a counterionic surfactant with a charge polarity of opposite sign to tile anionic surfactant of (ii) surfactant, and optionally a charge control agent;

(ii) shearing the pigment dispersion with a latex comprised of resin, anionic surfactant, nonionic surfactant, and water; and wherein the latex solids content, which solids are comprised of resin, is from about 50 percent to about 20 weight percent thereby causing a flocculation or heterocoagulation of the formed particles of pigment, resin and optional charge control agent; diluting with water to form a dispersion of total solids of from about 30 percent to 1 weight percent, which total solids are comprised of resin, pigment and optional charge control agent contained in a mixture of said nonionic, anionic and cationic surfactants;

(iii) heating the above sheared blend at a temperature of from about 5 to about 25° C. below about the glass transition temperature Tg of the resin while continuously stirring to form toner sized aggregates with a narrow size dispersity; and (iv) heating the electrostatically bound aggregated particles at a temperature of from about 5° to about 50° C. above about the Tg of the resin, and which heating is accomplished at a pH of 4 to 6 to provide a toner composition comprised of resin, pigment and optionally a charge control agent, and which toner is washed with an aqueous basic solution of, for example, sodium hydroxide of between pH 10 and 12 to provide a toner with a triboelectirc charge of between 25 and 50 microcoulombs per grams of the dried toner. The present invention in embodiments is directed to a process for the preparation of toner compositions comprising (i) preparing a pigment dispersion, which dispersion is comprised of a pigment, an ionic surfactant, and optionally a charge control agent;

(ii) shearing said pigment dispersion with a latex or emulsion blend comprised of a nonionic surfactant, resin, and a counterionic surfactant with a charge polarity of opposite sign to that of said ionic surfactant;

(iii) heating the above sheared blend below about the glass transition temperature (Tg) of the resin to form electrostatically bound toner size aggregates with a narrow particle size distribution;

(iv) heating the electrostatically bound aggregates above about the Tg of tile resin, which heating is accomplished at a pH of from about 4.0 to about 6.0, while continuously stirring the electrostatically bound aggregates to form toner particles;.

(v) washing the toner particles with a basic aqueous solution which solution is of a pH of from between about 10.0 and about 12.0; and thereafter optionally (vi) separating the toner particles from the emulsion blend containing water by filtration and then drying the toner particles.

In embodiments, the present invention is directed to processes for the preparation of toner compositions which comprises initially attaining or generating an ionic pigment dispersion, for example, by dispersing an aqueous mixture of a pigment or pigments, such as phthalocyanine, quinacridone or Rhodamine B type with counterionic surfactant, such as a cationic surfactant such as benzalkonium chloride by utilizing a high shearing device such as a Brinkmann Polytron, thereafter shearing this mixture by utilizing a high shearing device, such as a Brinkmann Polytron, a sonicator or microfluidizer with a controlled solids content of suspended resin mixture comprised of polymer or resin particles, such as poly(styrene butadiene) or poly(styrenebutylacrylate), and of a particle size ranging from 0.01 to about 0.5 micron, in an aqueous surfactant mixture containing an anionic surfactant such as sodium dodecylbenzene sulfonate and nonionic surfactant; resulting in a flocculation, or heterocoagulation of the resin particles with the pigment particles caused by the neutralization of cationic surfactant absorbed on the pigment particle with the oppositely charged anionic surfactant absorbed on the resin particles; and further for from about 1 to about 4 hours stirring the mixture using a mechanical stirrer at 250 to 500 rpm and allowing the formation of electrostatically stabilized aggregates ranging in diameter of from about 0.5 micron to about 10 microns; and heating for 1 to 6 hours from about 60° to about 95° C. and at a pH of between 4 and 6 to provide for particle fusion or coalescence of the polymer and pigment particles; followed by washing with a base to remove strongly bonded surfactant and to ionize acid groups on the surface of the toner particles; and drying such as by use of an Aeromatic fluid bed dryer whereby toner particles comprised of resin and pigment with various particle size diameters can be obtained, such as from about 1 to about 10 microns in average volume particle diameter as measured by the Coulter Counter.

Also, in embodiments the present invention is directed to processes for the preparation of toner compositions, which comprises (i) preparing an ionic pigment mixture by dispersing a pigment, such as carbon black like REGAL 330®, HOSTAPERM PINK™, or PV FAST BLUE™, of from about 2 to about 10 percent by weight of toner in an aqueous mixture containing a cationic surfactant, such as dialkylbenzene dialkylammonium chloride like SANIZOL B-50™ available from KAO or MIRAPOL™ available from Alkaril Chemicals, of from about 0.5 to about 2 percent by weight of water, utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE™ or poly(styrene-butadiene) of from about 88 percent to about 98 percent by weight of the toner, and of about 0.1 micron to about 3 microns polymer particle size in volume average diameter, and counterionic surfactant, such as an anionic surfactant like sodium dodecyl sulfate, dodecylbenzene sulfonate or NEOGEN R™, of from about 0.5 to about 2 percent by weight of water, a nonionic surfactant, such polyethylene glycol or polyoxyethylene glycol nonyl phenyl ether or IGEPAL 897™ obtained from GAF Chemical Company, of from about 0.5 to about 3 percent by weight of water, thereby causing a flocculation or heterocoagulation of pigment, charge control additive and resin particles; (iii) optionally diluting the aggregate particle mixture with water from about 30 percent solids to about 25 to 2 percent solids; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer at from about 250 to about 500 rpm to form electrostatically stable aggregates of from about 0.5 micron to about 5 microns in average volume diameter; and heating below the resin Tg; (v) heating the statically bound aggregate composite particles adjusted to a pH of 4 to 6 by adding an effective amount of a base, such as sodium or potassium hydroxide, of from about 60° C. to about 95° C. for a duration of about 60 minutes to about 600 minutes to form toner sized particles of from about 3 microns to about 7 microns in volume average diameter and with a geometric size distribution of from about 1.2 to about 1.4 as measured by the Coulter Counter; and (vi) isolating the toner sized particles by washing, filtering and drying thereby providing a toner comprised of polymeric resin, pigment and optionally charge control agent. Additives to improve flow characteristics and charge additives to improve charging characteristics may be optionally added by blending with the toner, such additives including AEROSILS® or silicas, metal oxides like tin, titanium and the like, of from about 0.1 to about 10 percent by weight of the toner.

In some instances, pigments, which are available in the wet cake or concentrated form containing water, can be easily dispersed utilizing a homogenizer or with stirring. In other instances, pigments are available in a dry form, whereby a dispersion in water can be effected by microfluidizing using, for example, a M-110 microfluidizer, and passing the pigment dispersion from about 1 to 10 times through the fluidizer chamber, or by sonication, such as using a Branson 700 sonicator, with the optional addition of dispersing agents such as the aforementioned ionic or nonionic surfactants.

Embodiments of the present invention include a process for the preparation of toner compositions comprising (i) preparing a pigment dispersion in water, which dispersion is comprised of a pigment and a cationic surfactant;

(ii) shearing the pigment dispersion with a latex containing a controlled resin solid contents of from about 50 percent to about 20 percent of polymer or resin, an anionic surfactant and nonionic surfactant in water, thereby causing a flocculation or heterocoagulation of the formed particles of pigment, resin and charge control agent to form a dispersion of total solids of from about 30 percent to 2 percent comprised of resin and pigment particles contained in the mixture of nonionic, anionic and cationic surfactants;

(iii) heating the above sheared blend at a temperature of from about 5° to about 25° C. below about the glass transition temperature Tg of the resin, or about equal to the Tg while continuously stirring to form toner sized aggregates with a narrow size dispersity; and (iv) heating the electrostatically bound aggregated particles at a pH of 4, 5, or 6, and at a temperature of from about 5° to about 50° C. above about the Tg of the resin to provide said toner composition comprised of resin and pigment; followed by washing as indicated herein.

Embodiments of the present invention include a process for the preparation of toner compositions with controlled particle size comprising (i) preparing a pigment dispersion in water, which dispersion is comprised of a pigment and counterionic surfactant;

(ii) shearing the pigment dispersion with a latex, which latex contains a resin solid content of from about 50 percent by weight to about 20 percent by weight, an anionic surfactant, and nonionic surfactant in water thereby causing a flocculation or heterocoagulation of the formed particles of pigment and resin to form a uniform dispersion of total solids of from about 30 percent by weight to about 2 percent by weight comprised of resin and pigment particles dispersed in the mixture of nonionic, anionic and counterionic surfactants;

(iii) heating the above sheared blend at a temperature of from about 5° to about 25° C. below the glass transition temperature Tg of the resin while continuously stirring to form toner sized aggregates with a narrow size dispersity;

(iv) heating at a pH of 4 to 6 the electrostatically bound aggregated particles at a temperature of from about 5° to about 50° C. above the Tg of the resin to provide said toner composition comprised of resin and pigment; and optionally (v) separating the toner particles from the water in (i) by filtration, or centrifugation; and (vi) drying the toner particles.

Illustrative examples of resins selected for the process of the present invention include known polymers like poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc), PLASTHALL™ (Rohm & Hass), CYGAL™ (American Cyanamide), ARMCO™ (Armco Composites), CELANEX™ (Celanese Eng), RYNITE™ (DuPont), STYPOL™, and the like. The resin particles selected, which generally can be in embodiments styrene acrylates, styrene butadienes, styrene methacrylates, or polyesters, are present in various effective amounts, such as from about 85 weight percent to about 98 weight percent of the toner, and can be of small average (resin) particle size such as from about 0.01 micron to about 1 micron in average volume diameter as measured by the Brookhaven nanosize particle analyzer.

The resin selected for the process of the present invention can be prepared by emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-Nmethylpyridinium chloride, and the like. The presence of acid or basic groups is optional and such groups can be present in various amounts of from about 0.1 to about 10 percent by weight ofthe polymer resin. Known chain transfer agents, such as dodecanethiol or carbon tetrachloride, can also be selected when preparing resin particles by emulsion polymerization. Other processes for obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes. Also, the resins selected can be purchased.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®, REGAL 400®, REGAL 660®; magnetites, such as Mobay magnetites MO8029™, MO8060™; Columbian magnetites; MAPICO BLACKS™ and surface treated magnetites; Pfizer magnetites, CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and other equivalent black pigments. As colored pigments there can be selected known cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, red, blue, green, brown, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments or dyes selected are present in various effective amounts, such as from about 1 weight percent to about 65 weight and preferably from about 2 to about 12 percent of the toner.

The toner may also. include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in amounts of, for example, 0.1 to about 25 weight percent in embodiments include, for example, nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is, for example, from about 0.01 to about 10 percent by weight, and preferably from about 0.1 to about 5 percent by weight of monomers selected to prepare the copolymer resin, or in amounts as indicated herein.

Examples of ionic surfactants include cationic and anionic surfactants with examples of anionic surfactants being, for example, sodium dodecyl sulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ from Kao, and the like. An effective concentration of the anionic surfactant generally employed is, for example, from about 0.01 to about 10 percent by weight, and preferably from about 0.1 to about 5 percent by weight of monomers selected to prepare the copolymer resin, or in amounts as indicated herein.

Examples of cationic surfactants selected for the processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$,$C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as, for example, from about 0.1 percent to about 5 percent by weight of water. Preferably the molar ratio of the cationic surfactant used for flocculation to the anionic surfactant used in the latex preparation is in range of about 0.5 to 4, and preferably from about 0.5 to 2.

The temperature for the aggregation is preferably accomplished in the range of from about 5° C. to about 20° C. below the resin Tg, which resin Tg is, for example, from about 45° C. to about 80° C., and preferably from about 30° C. to about 50° C., while being stirred for from about 1 to about 4 hours for example. The resulting total solids comprise latex particles and pigment particles. The aggregate particles are then coalesced by raising the temperature to about 5° C. to about 50° C. above the resin Tg, for example, from about 60° C. to about 95° C. and wherein the pH is a critical 4 to 6.

Surface additives that can be added to the toner compositions after washing or drying include, for example, metal salts, metal salts of fatty acids like zinc stearate, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Adjustment of the pH of the suspension of particles prior to increasing the temperature above the Tg of the resin can be accomplished by adding a base, such as sodium or potassium hydroxide, to the suspension while continuously monitoring the pH with a pH electrode immersed in the suspension. The pH was preferably monitored using an Orion pH meter. The washing of the toner particles with base at between a pH of 10 and 12 was accomplished by dispersing the toner particles in an aqueous solution of a base such as sodium or potassium hydroxide, and then separating the particles from the water by filtration. The tribocharging behavior of the toner was evaluated by charging a carrier comprised, for example, of a core with a polymer coating thereover with 3 percent by weight of the toner and determining the tribo charge after 30 minutes of agitation in a glass jar by using the known Faraday Cage blow-off tribo apparatus.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Latex solids refers in embodiments to the amount of resin, such as 50 to 20 weight percent of the latex of (ii); and total solids refers in embodiments to resin, pigment, and optional charge additive or charge control agent. The solids contents, that is resin, is reduced by diluting with water, for example, to from about 30 to about 1 percent by weight of total solids. Various effective amounts of water can be selected for dilution as indicated herein.

The following Examples are being submitted to further define various species of the present invention. These Examples are intended to be illustrative only and are not intended to limit the scope of the present invention. Also, parts and percentages are by weight unless otherwise indicated.

Preparation of the Toner Resin:

A latex was prepared by emulsion polymerization as follows:

Latex A: 4,920 Grams of styrene, 1,080 grams of butyl acrylate, 120 grams of acrylic acid, 60 grams of carbon tetrabromide and 210 grams of dodecanethiol were mixed with 9,000 grams of deionized water in which 135 grams of sodium dodecyl benzene sulfonate (SDBS) anionic surfactant (NEOGEN R™ which contains 60 percent of active component and 40 percent of water component), 129 grams of polyoxyethylene nonyl phenyl ether-nonionic surfactant (ANTAROX 897™-70 percent active-polyethoxylated alkylphenols), and 60 grams of ammonium persulfate initiator were dissolved. The emulsion was then polymerized at 80° C. for 5 hours. A latex containing 40 percent solids of polymeric or resin particles of a copolymer of styrene, butylacrylate and acrylic acid (88/12/2 parts) with a particle size of 150 nanometers, as measured on Brookhaven nanosizer, was obtained. Tg=53° C., as measured on DuPont DSC. $M_w$=20,000, and $M_n$=6,000 as determined on Hewlett Packard GPC. The aforementioned latex was then selected for the toner preparation of the Examples.

Preparation of the Pigment Dispersion

A pigment dispersion was prepared as follows:

Pigment Dispersion B: 280 Grams of dry PV FAST BLUE™ pigment and 58.5 grams of the cationic or counterionic surfactant SANIZOL B-50™ were suspended in 8,000 grams of distilled water and subsequently passed through a microfluidizer until the dispersion was homogeneous. This mixture was then utilized to form the toner in all the Examples.

PREPARATION OF TONER PARTICLES

COMPARATIVE EXAMPLE

417 Grams of the PV FAST BLUE™ dispersion (Pigment B) and 650 grams of the latex (Latex A) were simultaneously added into a SD41 continuous blending device which contained and was diluted with 1,200 grams of water. Homogenization was achieved by recirculating the contents of the SD41 continuously through the shearing chamber at 10,000 rpm for 8 minutes. The product resulting was then transferred to a controlled temperature kettle and heated at 45° C. while gently stirring for 3 hours. The aggregate produced had a diameter of 5.1 microns average volume diameter with a GSD of 1.21 as determined by particle diameter measurements using the Coulter Counter (Microsizer II). At this point, 40 grams of a 20 percent by weight solution of NEOGEN R™ in water was added to the kettle to prevent the formed aggregates from further aggregating and increasing in size during the following coalescence stage of the process.

The pH of the kettle contents was determined to be 2.1 using an Orion pH meter. The kettle contents were then heated to 90° C. while stirring at 100 rpm for about 4 hours. The particle size was measured again on the Coulter Counter. Toner particles of 5.1 microns were obtained with a GSD=1.21, indicating no further change in the particle size. The particles were then washed with hot deionized water until the conductivity and surface tension of the wash water was the same as that of the deionized water. The toner particles were then separated from the water by filtration and dried. The aforementioned cyan toner was comprised of 88 parts of polystyrene, 12 parts of polybutylacrylate, 2 parts of polyacrylic acid and 5.5 percent (5.61 parts) of cyan pigment particles prepared under conditions of 11.5 percent solids or resin loading of the latex in the blend of (ii) of resin, pigment, nonionic, anionic, cationic surfactant and water. The yield of the toner particles was 98 percent. The toner's particles formed in this manner. The toners were observed to have a rough surface morphology. The triboelectric charge of these toners was determined, using a blow off tribo measuring apparatus, to be −10 microcoulombs/gram when charged against a Xerox 4850 carrier.

EXAMPLE I

417 Grams ofthe PV FAST BLUE™ dispersion (Pigment B) and 650 grams of the latex (Latex A) were simultaneously added into a SD41 continuous blending device which contained and was diluted with 1,200 grams of water. Homogenization was achieved by recirculating the contents of the SD41 continuously through the shearing chamber at 10,000 rpm for 8 minutes. The product resulting was then transferred to a controlled temperature kettle and heated at 45° C. while gently stirring for 3 hours. The aggregate produced had a diameter of 5.1 microns average volume diameter with a GSD of 1.21 as determined by particle diameter measurements using the Coulter Counter (Microsizer II). At this point, 40 grams of a 20 percent by weight solution of NEOGEN R™ in water were added to the kettle to prevent the formed aggregates from further aggregating and increasing in size during the following coalescence stage of the process.

The pH of the kettle contents was increased to 5.5 units by the addition of a 5 Molar solution of sodium hyroxide, the pH being monitored using an Orion pH meter. The kettle contents were then heated to 90° C. while stirring at 100 rpm for about 4 hours. The particle size was measured again on the Coulter Counter. Toner particles of 5.1 microns were obtained with a GSD=1.21, indicating no further change in the particle size. The particles were then washed with hot deionized water until the conductivity and surface tension of the wash water was the same as that of the deionized water and then separated from the water by filtration and dried. The aforementioned cyan toner was comprised of 88 parts of polystyrene, 12 parts of polybutylacrylate, 2 parts of polyacrylic acid, and 5.5 percent (5.61 parts) of cyan pigment particles under conditions of 11.5 percent solids or resin loading of the latex in the blend of (ii) of resin, pigment, nonionic, anionic, cationic surfactant and water. The yield of the toner particles was 98 percent. The toners were observed to be spherical in contrast to the rough surface features observed in the Comparative Example. The triboelectric charge of these toners was determined, using a blow off tribo measuring apparatus, to be −15 microcoulombs/gram when charged against a Xerox Corporation 4850 carrier comprised of Hoeganese rough steel core with a 0.8 weight percent of a coating of KYNAR® and polymethylmethacrylate (PMMA), and which coating contains 20 weight percent of VULCAN 72R™ carbon black carrier, and this value was slightly larger than that found for the toner produced in the Comparative Example. The toner of this Example was spherical in shape and did not possess rough surface features, reference the Comparative Example toner.

EXAMPLE II

417 Grams of the PV FAST BLUE™ dispersion (Pigment B) and 650 grams of the latex (Latex A) were simultaneously added into a SD41 continuous blending device which contained and was diluted with 1,200 grams of water. Homogenization was achieved by recirculating the contents of the SD41 continuously through the shearing chamber at 10,000 rpm for 8 minutes. The product resulting was then transferred to a controlled temperature kettle and heated at 45° C. while gently stirring for 3 hours. The aggregate produced had a diameter of 5.1 microns average volume diameter with a GSD of 1.21 as determined by particle diameter measurements using the Coulter Counter (Microsizer II). Subsequently, 40 grams of a 20 percent by weight solution of NEOGEN R™ in water was added to the kettle to prevent the formed aggregates from further aggregating and increasing in size during the following coalescence stage of the process.

The pH of the kettle contents was increased from a pH of 2.2 to a pH of 4.5 units by the addition of a 5 Molar solution of sodium hyroxide, the pH being monitored using an Orion pH meter. The kettle contents were then heated to 90° C. while stirring at 100 rpm for about 4 hours. The particle size was measured again on the Coulter Counter. Toner particles of 5.1 microns were obtained with a GSD=1.21, indicating no further change in the particle size. The particles were then washed with hot water with a pH of 11.5, prepared by the addition of 5M sodium hydroxide to deionized water, until the surface tension of the wash water was the same as that of the original pH 11.5 water, and the toner was then separated from the water by filtration and dried. The aforementioned cyan toner was comprised of 88 parts of polystyrene, 12 parts of polybutylacrylate, 2 parts of polyacrylic acid and 5.5 percent (5.61 parts) of cyan pigment particles prepared under conditions of 11.5 percent solids or resin loading of the latex in the blend of (ii) of resin, pigment, nonionic, anionic, cationic surfactant and water. The yield of the toner particles was 98 percent. The toner resulting was observed to possess a smoother surface texture than the toner of the Comparative Example. The triboelectric charge of this toner was determined, using a blow off tribo measuring apparatus, to be −35 microcoulombs/gram when charged against the Xerox Corporation 4850 carrier, and this value was 350 percent larger than that found for the toner of the Comparative Example.

EXAMPLE III

417 Grams ofthe PV FAST BLUE™ dispersion (Pigment B) and 650 grams of the latex (Latex A) were simultaneously added into a SD41 continuous blending device which contained and was diluted with 1,200 grams of water. Homogenization was achieved by recirculating the contents of the SD41 continuouslythrough the shearing chamber at 10,000 rpm for 8 minutes. The product resulting was then transferred to a controlled temperature kettle and heated at 45° C. while gently stirring for 3 hours. The aggregate produced had a diameter of 5.1 microns average volume diameter with a GSD of 1.21 as determined by particle diameter measurements using the Coulter Counter (Microsizer II). At this point, 40 grams of a 20 percent by weight solution of NEOGEN R™ in water was added to the kettle to prevent the formed aggregates from further aggregating and increasing in size during the following coalescence stage of the process.

The pH of the kettle contents was increased to 5.5 units by the addition of a 5 Molar solution of sodium hyroxide, the pH being monitored using an Orion pH meter. The kettle contents were then heated to 90° C. while stirring at 100 rpm for about 4 hours. The particle size was measured again on the Coulter Counter. Toner particles of 5.1 microns were obtained with a GSD=1.21, indicating no further change in the particle size. The particles were then washed with hot water with a pH of 11.5, prepared by the addition of 5M sodium hydroxide to deionized water, until the surface tension of the wash water was the same as that of the original pH 11.5 water, and the toner was then separated from the water by filtration and dried. The aforementioned cyan toner was comprised of 88 parts of polystyrene, 12 parts of polybutylacrylate, 2 parts of polyacrylic acid and 5.5 percent (5.61 parts) of cyan pigment particles prepared under conditions of 11.5 percent solids, or resin loading of the latex in the blend of (ii) of resin, pigment, nonionic, anionic, cationic surfactant and water. The yield of the toner particles was 98 percent. The toner generated was observed to be spherical. The triboelectric charge of this Example III toner was determined, using a blow off tribo measuring apparatus, to be −40 microcoulombs/gram when charged against a Xerox Corporation 4850 carrier, and this value was considerably larger than that found for the toner produced by the process described in the Comparative Example or in Example I.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions comprising (i) preparing a pigment dispersion in water, which dispersion is comprised of a pigment, an ionic surfactant, and optionally a charge control agent;

(ii) shearing said pigment dispersion with an aqueous latex or emulsion blend comprised of a nonionic surfactant, resin, and a counterionic surfactant with a charge polarity of opposite sign to that of said ionic surfactant;

(iii) heating the above sheared blend below about the glass transition temperature (Tg) of the resin to form electrostatically bound toner size aggregates with a narrow particle size distribution;

(iv) heating the electrostatically bound aggregates above about the Tg of the resin, which heating is accomplished at a pH of from about 4.0 to about 6.0 while continuously stirring the electrostatically bound aggregates to form toner particles;

(v) washing the toner particles with a basic aqueous solution, which solution is of a pH of from between about 10.0 and about 12.0; and thereafter optionally (iv) separating the toner particles from the emulsion blend containing water by filtration and then drying the toner particles.

2. A process in accordance with claim 1 wherein a pH in (v) of from between 10 to 12 is achieved by the addition of a base component of an alkali metal hydroxide or ammonium hydroxide.

3. A process in accordance with claim 1 wherein a pH in (iv) of from between 4 to 6 is achieved by the addition of a base component of an alkali metal hydroxide or ammonium hydroxide.

4. A process in accordance with claim 2 wherein a pH in (v) of 10, 11, or 12 is achieved by the addition of a base component of an alkali metal hydroxide or ammonium hydroxide, and the toner particles are separated from the emulsion blend containing water by filtration, followed by drying the toner particles.

5. A process in accordance with claim 3 wherein a pH in (iv) of about 4 or 5 is achieved by the addition of a base component of an alkali metal hydroxide or ammonium hydroxide, and the toner particles are separated from the emulsion blend containing water by filtration, followed by drying the toner particles.

6. A process in accordance with claim 1 wherein the surfactant utilized in preparing the pigment dispersion is a cationic surfactant, and the Tg in (iii) and (iv) from about 45° to about 90° C.

7. A process in accordance with claim 1 wherein the concentration of resin in the latex is from about 60 percent to about 20 percent.

8. A process in accordance with claim 1 wherein the content of the resin solids after flocculation in (ii) is controlled to from about 20 percent to about 5 percent by weight, and the particle size of the aggregate in (iii) is from about 1 micron to about 15 microns in average volume diameter.

9. A process in accordance with claim 1 wherein the dispersion of (i) is accomplished by homogenizing at from about 1,000 revolutions per minute to about 10,000 revolutions per minute at a temperature of from about 25° C. to about 35° C. for a duration of from about 1 minute to about 120 minutes.

10. A process in accordance with claim 1 wherein the dispersion of (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

11. A process in accordance with claim 1 wherein the dispersion of (i) is accomplished by microfluidization in a microfluidizer or in nanojet for a duration of from about 1 minute to about 120 minutes.

12. A process in accordance with claim 1 wherein the shearing of (ii) is accomplished by homogenizing at from about 1,000 revolutions per minute to about 10,000 revolutions per minute for a duration of from about 1 minute to about 120 minutes.

13. A process in accordance with claim 1 wherein the heating of the blend of latex, pigment, surfactants and optional charge control agent in (iii) is accomplished at temperatures of from about 5° C. to about 20° C. below the Tg of the resin, which Tg is in the range of from about 48° C. to about 72° C., and which heating is accomplished for a duration of from about 0.5 hour to about 6 hours, and thereafter separating the toner particles from the emulsion blend containing water by filtration, and then drying the toner particles.

14. A process in accordance with claim 1 wherein the heating of the electrostatically bound aggregate particles to form toner size composite particles comprised of pigment, resin and optional charge control agent is accomplished at a temperature of from about 10° C. above the Tg of the resin to about 95° C. above the Tg of the resin, and for a duration of from about 1 hour to about 8 hours.

15. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alphamethylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

16. A process in accordance with claim 1 wherein the resin is selected from the group consisting of poly(styrene-butadiene-acrylic acid), poly(styrene-butadiene-methacrylic acid), poly(styrene-butylmethacrylate-acrylic acid), poly(styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, poly(styrene-butadiene), and polyoctalene-terephthalate.

17. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and the anionic surfactant is selected from the group consisting of sodium dodecyl sulfate, sodium dodecylbenzene sulfate and sodium dodecylnaphthalene sulfate; and the cationic surfactant is a quaternary ammonium salt.

18. A process in accordance with claim 1 wherein the resin utilized in (ii) is from about 0.01 to about 3 microns in average volume diameter, and the pigment particles are from about 0.01 to about 1 micron in average volume diameter.

19. A process in accordance with claim 1 wherein the statically bound aggregate particles formed in (iv) are about 1 to about 10 microns in average volume diameter, the toner obtained is from about 2 to about 15 microns in average volume diameter, and the toner geometric size distribution is from about 1.15 to about 1.30.

20. A process in accordance with claim 1 wherein the nonionic surfactant concentration is about 0.1 to about 5 weight percent of the toner components of resin and pigment; the anionic surfactant concentration is about 0.1 to about 5 weight percent of the toner components of resin and pigment; and the counterionic surfactant concentration is about 0.1 to about 5 weight percent of the toner of resin and pigment.

21. A process in accordance with claim 1 wherein there is added to the surface of the isolated toner particles additives of metal salts, metal salts of fatty acids, silicas, metal oxides, or mixtures thereof in an amount of from about 0.1 to about 10 weight percent.

22. A process in accordance with claim 1 wherein the toner particles isolated are from about 3 to about 15 microns in volume average diameter, and the geometric size distribution is from about 1.15 to about 1.25.

23. A process for the preparation of toner with controlled particle size comprising (i) preparing a pigment dispersion in water, which dispersion is comprised of a pigment and counterionic surfactant;

(ii) shearing the pigment dispersion with a latex, which latex contains a resin content of from about 50 percent by weight to about 20 percent by weight, thereby causing a flocculation or heterocoagulation of the formed particles of pigment and resin; diluting with water to form a uniform dispersion of total solids of from about 30 percent by weight to about 2 percent by weight;

(iii) heating the above sheared blend at a temperature of from about 5° C. to about 25° C. below about the glass transition temperature (Tg) of the resin while continuously stirring to form toner sized aggregates with a narrow size dispersity;

(iv) heating the electrostatically bound aggregated particles at a pH of from about 4.0 to about 6.0, and at a temperature of from about 5° C. to about 50° C. above about the Tg of the resin to provide said toner composition comprised of polymeric resin, pigment and optionally a charge control agent; and optionally (v) contacting the toner composition with a base (vi) separating said toner particles from the water; and (vii) drying said toner particles; and wherein said latex comprises resin, anionic surfactant, nonionic surfactant and water, and said total soliids components are comprised of resin and pigment.

24. A process in accordance with claim 23 wherein the (iii) and (iv) resin glass transition temperature (Tg) is from about 50° C. to about 80° C.

25. A process in accordance with claim 23 wherein the resin glass transition temperature (Tg) is from about 45° C. to about 90° C.

26. A process for the preparation of toner comprising (i) preparing a pigment dispersion, which dispersion is comprised of a pigment, and an ionic surfactant;

(ii) shearing said pigment dispersion with a latex or emulsion blend comprised of a nonionic surfactant, resin, and a counterionic surfactant with a charge polarity of opposite sign to that of said ionic surfactant, followed by diluting with water;

(iii) heating the above sheared blend at about equal to, or below about the glass transition temperature (Tg) of the resin to form electrostatically bound toner size aggregates;

(iv) heating the electrostatically bound aggregates about equal to or about above the Tg of the resin, which heating is accomplished at a pH of from about 4.0 to about 6.0, and which heating is accomplished while continuously stirring the electrostatically bound aggregates;

(v) washing the toner particles with a basic aqueous solution, which solution is of a pH of from between about 10.0 and about 12.0; and thereafter (vi) separating the toner particles from the emulsion blend containing water by filtration, and then drying the toner particles.

* * * * *